US006702164B1

(12) United States Patent
De Lathouwer

(10) Patent No.: US 6,702,164 B1
(45) Date of Patent: Mar. 9, 2004

(54) RUCKSACK WITH INTEGRATED ROLLING AND TRACTION SYSTEM

(75) Inventor: Roger De Lathouwer, Brussels (BE)

(73) Assignee: Rodelle S.A., Brussels (BE)

( * ) Notice: Subject to any disclaimer, the term of this patent is extended or adjusted under 35 U.S.C. 154(b) by 0 days.

(21) Appl. No.: 09/806,755

(22) PCT Filed: Oct. 1, 1999

(86) PCT No.: PCT/BE99/00125

§ 371 (c)(1),
(2), (4) Date: Apr. 2, 2001

(87) PCT Pub. No.: WO00/19862

PCT Pub. Date: Apr. 13, 2000

(30) Foreign Application Priority Data

Oct. 2, 1998 (BE) ..... 9800714

(51) Int. Cl.[7] ..... A45F 4/02

(52) U.S. Cl. ..... 224/153; 190/18 K; 190/115

(58) Field of Search ..... 224/113, 628, 224/630, 633, 644, 575, 576; 190/18 A, 18 K, 126, 127, 115, 100, 15.1; 280/37, 40, 655, 655.1; 124/575, 576

(56) References Cited

U.S. PATENT DOCUMENTS

| | | | | | |
|---|---|---|---|---|---|
| 2,061,091 | A | * | 11/1936 | Roth | 190/127 |
| 2,269,574 | A | * | 1/1942 | Benefeld | 190/126 |
| 4,784,248 | A | * | 11/1988 | Workman | 188/218 XL |
| 5,575,362 | A | * | 11/1996 | Franklin et al. | 16/113.1 |
| 5,634,538 | A | * | 6/1997 | Tsai | 190/126 |
| 5,749,503 | A | * | 5/1998 | Wulf et al. | 224/153 |
| 5,806,638 | A | * | 9/1998 | Mao | 16/405 |
| 5,918,710 | A | * | 7/1999 | Sher | 16/110.1 |

* cited by examiner

*Primary Examiner*—Lee Young
*Assistant Examiner*—Wen Ngo
(74) *Attorney, Agent, or Firm*—Armstrong, Kratz, Quintos, Hanson & Brooks, LLP

(57) ABSTRACT

A rucksack with supple material walls comprising a retractable handle (7) and wheels. An incurvated interior base plate (2) is provided, plate made to form one piece with the base of at least one telescopic housing (10) of the rod(s) (1) of the retractable handle (7), housing provided internally in the baggage along one face. The aforesaid base plate (2) comprises openings (8, 8') at the incurvation, openings receiving projecting wheels (5). The upper extremity (10) of the telescopic housing(s) is made to form one piece with a supporting plate (3) of the supple material extending perpendicular to the telescopic system. The face in contact with the back and provided with straps (31) is opposite the face adjacent to the telescopic housing (10).

16 Claims, 4 Drawing Sheets

RUCKSACK WITH INTEGRATED ROLLING AND TRACTION SYSTEM

This application claims the benefit of PCT application No. PCT/BE99/00125 filled Oct. 01, 1999, and foreign application BELGIUM 9800741 filed Oct. 02, 1998.

This invention relates to baggage comprising a rigid retractable handle and is suitable for being drawn on wheels. The invention relates more particulary to a rucksack.

Several types of rucksack are known provided with wheels and a retractable handle. This type of baggage with supple material walls has proved to be particularly practical and has experienced an increasing success over these past years. This baggage consists of a bag adapted to a rolling system provided for suitcases, which results in a relatively heavy and cumbersome bag.

Indeed suitcases or rucksacks on wheels derived from the "trolley" type of rolling suitcases are already known. It relates in fact to utilizing a cabin suitcase telescopic system (so-called "trolley") to which a rucksack has been adapted. Thus, the rucksacks on wheels of the former state-of-the-art comprise a retractable handle, generally formed by two sliding tubes, along the "rear" face or wall that means the one which is destined to be in contact with the back of the user. This disposition has a disadvantage from the point of view of comfort, the telescopic system of the handle being rigid. A significant additional padding is necessary in order to avoid direct contact of the back with this hard longitudinal element.

Furthermore the rolling system, originally provided in order to be mounted on a suitcase, is heavy, cumbersome and disproportionate. The rucksack is mounted in the place provided for the suitcase. The wheels are on the outside and located at the base of the aforesaid rear wall and are thus, when the baggage is used as a rucksack, likely to soil the clothes on the back of the user since these wheels have been in contact with the sidewalk and refuse, and possibly even with dog excrement. The presence of a flap suitable for enveloping the wheels only constitutes a makeshift because in order to return to using the wheels, the wall of the possibly soiled flap is exposed and can be in contact with the user.

Consequently an increase in the practical aspect and in the comfort in use of this rolling baggage, in particular rucksacks is being sought, while ensuring a decrease in weight without detracting from the solidity.

This invention aims a remedying the above mentioned inconveniences and at improving the qualities of comfort in use and of lightness. The rucksack is no longer adapted to a rolling system, this latter on the contrary being adapted to the form and the utilization of the rucksack.

With this objective the invention principally puts forward a rucksack with supple material walls, for example in fabric, comprising a handle retractable by sliding its shaft, and an incurvated interior base plate, the incurvation of this semi-rigid plate being imposed by the integration into one piece of this plate, e.g. by riveting, with a segment of incurvated profile extending from the base of the telescopic housing, inside the baggage, of the sliding handle. The semirigid plate can be a plastic plate, for example in polyethylene with a thickness varying from 1 to 5 mm.

The walls of the baggage in supple material will preferably be provided in order to form baggage of approximately right-angled parallelepipal form.

Instead of a handle with one rod, a telescopic U-shaped handle can also be provided, comprising two rods sliding in two parallel housings. Each housing is made to form one piece with the lower incurvated plate and with the upper plate as for the baggage with one single rod.

According to one variant, the base plate can be a more rigid molded plate, for example in ABS or polypropylene, whose incurvation is formed from origin. In this case, the base of the telescopic housing need not necessarily be incurvated and/or flattened and can be straight if a solid and rigid attachment means is provided on the raised part of the base plate (e.g. flange).

In the case of a semirigid plate, the incurvation is also obtained, in particular at its lateral parts, by two lateral wheel spindle support arch elements projecting out of the incurvated part of the aforesaid plate.

The telescopic handle system is provided adjacent to and inside the wall opposite to that which is destined to be in contact with the back, in other words to that provided with straps for use as rucksack. Comfort is thus greatly improved.

Advantageously the edge of the lower plate opposite the base of the telescopic housing has a concave curved horizontal section. This section, in contact with the back further conforms to the transverse profile of the back and thus increases the comfort of the user and/or prevents a premature wear and tear of a protective cushion provided on the wall in contact with the back.

Furthermore a pad can be provided which adapts to the rim exhibited by the aforesaid edge, for example in the form of a longitudinally split foam sheath.

The shaft of the retractable handle can consist of a hollow tube of square, rectangular or polygonal section, for example in aluminum, but can also constitute a U-shaped handle, in which case the section can be round. The shaft will nevertheless advantageously, especially for baggage of small dimensions, consist of a single or double telescopic tube sliding in known manner in a rigid housing provided for this purpose.

According to an important aspect of the invention a supporting plate for the supple material (e.g. fabric) is also provided, preferably but not compulsorily of the same nature as the incurvated base plate, disposed at the upper extremity of the housing of the telescopic handle, perpendicular to this housing. This plate is held by an attachment means, e.g. a tightening yoke provided for this purpose on the housing. The size of this plate can vary, in such manner that, according to one preferred embodiment, only a part of the supple material, encircling the upper extremity of the housing can be held. In particular, this supporting plate will preferably not extend over the entire depth of the suitcase.

The upper wall can therefore comprise an independent auxiliary plate, which only serves as a better attachment for a classical type of handle. Indeed, in classic manner, in addition to the telescopic handle, additional handles can be provided sewn and/or riveted onto one or several of the walls.

The vertical rigidity of the supple material rucksack is essentially ensured by the rolling system, the incurvated plate and the telescopic system. The invention therefore puts forward baggage whose rigid structure is essentially L-shaped, or in the form of an angle iron, to the extent that the transverse upper plate is of relatively reduced surface area, which favors stackability since the lateral faces and, partly, the upper wall can be folded over toward the inside.

According to one embodiment, the opening means of the rucksack described above will be a zip fastener extending from the upper face, over the lateral walls, on each side, in a manner such that once the rucksack is open, the part of the supple material supported by the upper plate is separated from the part of the unsupported supple material.

According to one variant, one of the walls comprises along three sides of its perimeter a zip fastener which enables the folding over of this wall.

The wall or part of the wall which can be folded over can comprise one or several pockets and/or one or several auxiliary compartments.

In the case of rucksacks of larger dimensions, a vertical reinforcement can advantageously be provided extending over a part of the wall adjacent to the telescopic system of the handle, integrated to form one piece with the upper plate by attachment to a bracket. According to one variant an integrated angle-iron element can be provided. A bracket is then no longer necessary.

According to another embodiment of the invention, an inverted U-shaped metallic retaining ring can moreover be provided running over the upper edge and the two lateral edges of the wall adjacent to the telescopic system. This retaining ring is advantageously integrated into a supple edging whose extremities exceed the branches of the U and are incurvated in order thus to form the two lateral lower edges.

According to yet another embodiment of the invention, the type of baggage described above need not comprise straps and can thus constitute a rolling cabin suitcase with one or two telescopic rods. This suitcase is characterized by the absence of lateral faces well defined by more rigid retaining ring frames which, for the other types of similar suitcases, ensure a thickness with spring effect when empty.

In this case, the wall opposite the telescopic system preferably has a zip fastener on three sides of the perimeter, enabling the folding-over of this wall. The opening being encircled by an edging, for example in metal.

Also in this case, an auxiliary supporting plate will advantageously be utilized perpendicular to the transverse upper plate, already mentioned for the rucksack, as well as to the U-shaped retaining ring reinforcing the wall adjacent to the telescopic system.

It should be clearly understood that the inner walls of the compartments of the baggage according to the invention can advantageously be lined with a fabric lining, which hides the base plate and the telescopic housing.

The invention will be better understood by examining the drawings submitted in appendix, only by way of example of preferred embodiments, in which FIG. 1 represents a diagram of the internal structure of a rucksack according to the invention.

Figure 5A:
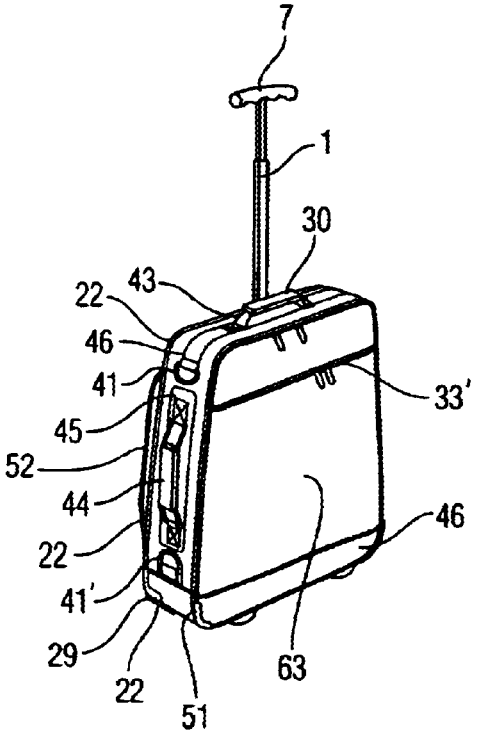
Figure 5B:
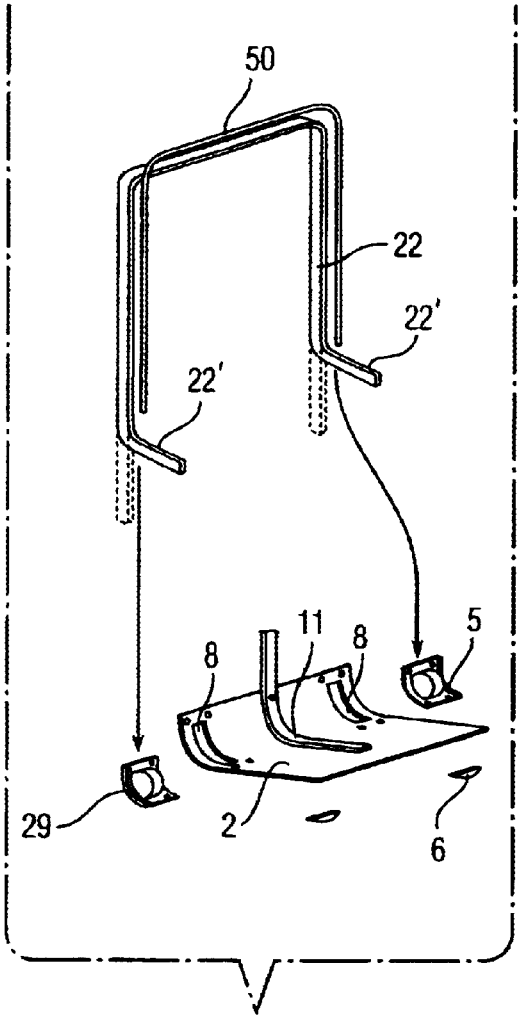
Figure 5C:
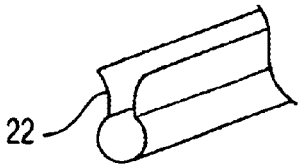

FIGS. 5*a*, 5*b* and 5*c* illustrate a variant of the invention applied to a piece of baggage which is not a rucksack.

In the various figures, identical reference numbers refer to identical or functionally equivalent element.

Figure 1:
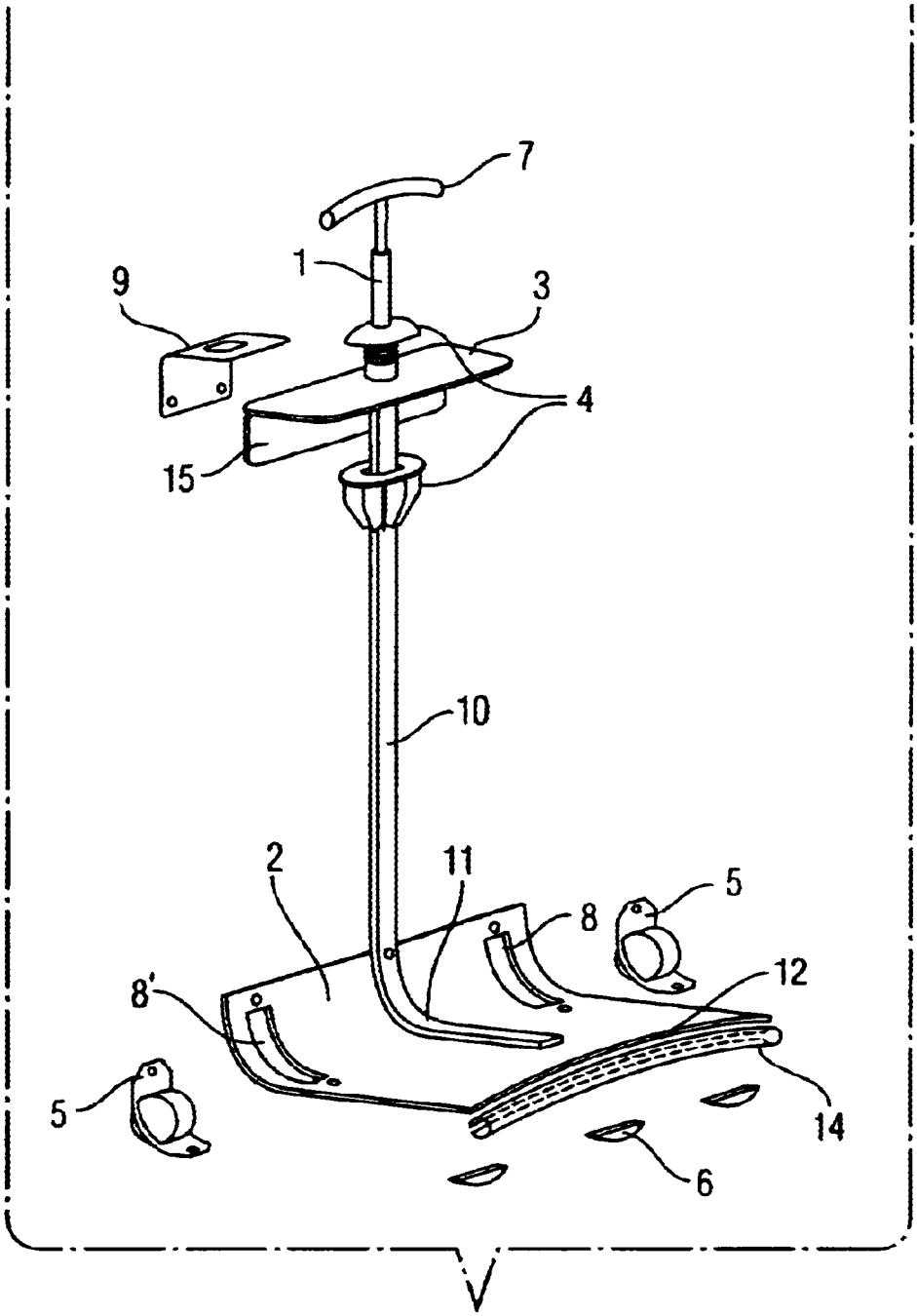

FIG. 1 schematically represents in perspective a partially exploded view of the rigid structure of a rucksack according to the invention. A rod or a shaft 1 and a metallic housing 10 can be recognized in which slides the doubly telescopic tube or shaft 1 of square or rectangular section, preferably in aluminum. The lower part 11 of the housing extends in the form of an incurvated segment with which a semirigid base plate 2 for example in polyethylene is made to form one piece by riveting. This incurvated part extending the telescopic housing can advantageously be flattened, and can in fact result from the flattening of an extremity of a hollow section of square or rectangular cross-section. The base plate 2 comprises two openings 8 for receiving the wheels provided on arched elements 5, to be made to form one piece on the outside by riveting to the plate 2. These arches thus contribute to the homogeneous incurvation over its entire width. Feet 6 of the side opposite the wheels are also illustrated.

It will be noted that the profile of the rim 12 of the plate can also be incurvated in order to conform better to the profile of the back, when the suitcase is used as rucksack. The rim moreover being covered with a longitudinally split protective sheath 14.

A supporting plate 3 of the same nature as the base plate is provided at the upper part of the housing 10, firmly held by an attachment means, for example a tightening yoke 4. Preferably this supporting plate will not extend over the entire thickness of the suitcase in order to prevent contact with the upper part of the back or with the neck of the user. A vertical reinforcement 15 is also illustrated, also in the form of a plate, made to form one piece with the supporting plate 3 by attachment to an intermediate bracket 9.

Figure 2:
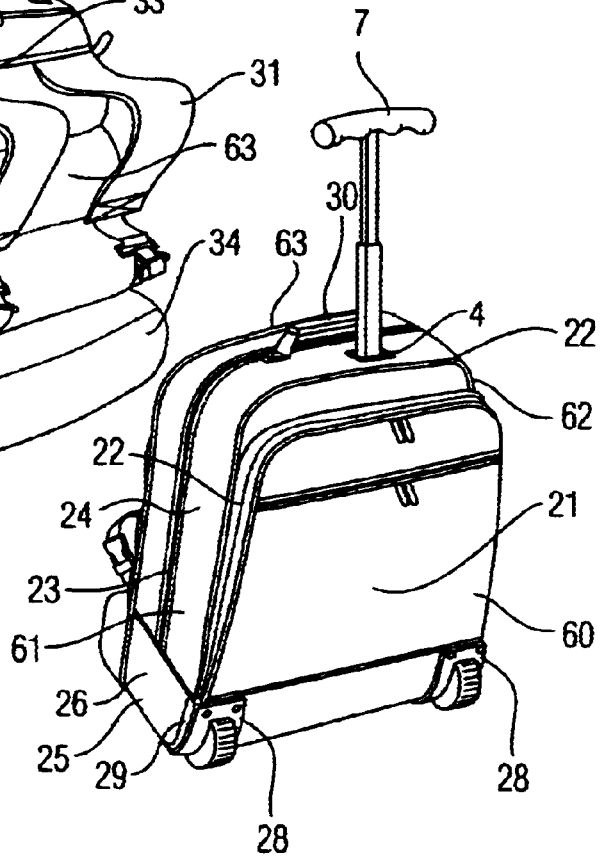
FIG. 2 represents in perspective a "front" view of a complete rucksack according to the invention.

FIG. 2 is a view in perspective of the rucksack seen from the side of the wall adjacent to the retractable handle, such wall being defined as the front wall 60. The telescopic mechanism is inside the rucksack. A front compartment 21 and the zip fastener 23 can be distinguished which extends over two lateral walls 61, 62 and the upper wall and by folding over the rear wall gives access to the main compartment 24. At the base of three vertical walls 60, 61, 62, the supple material is covered with a second material 25 preferably in plastic, for example in grained PVC, rendering the base of the lateral faces 26 less supple, decreasing wear and tear, and advantageously enabling an easier cleaning. The wheel arches 28 are located at the lower corners of the wall comprising the telescopic system and comprising an incurvated flange 29 for protecting the edging 22, conforming to the incurvated edge of the base plate. The interior supporting plate not shown extends up to the zipper 23 and also serves as support for the classic handle 30.

Figure 3:
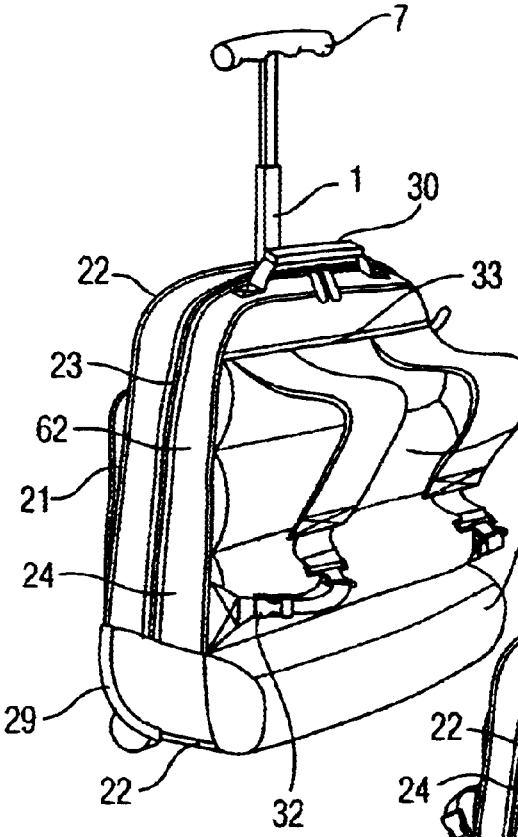
FIG. 3 represents a "rear" view of a rucksack according to the invention.

FIG. 3 is a representation of a rucksack similar to that from FIG. 2 viewed from the rear wall 63 opposite the front wall 60 adjacent to the retractable handle. The straps 31 can be distinguished which can be partially detached at the attachment buckles 32 and inserted into a pocket 33 provided for this purpose. Moreover a cushion 34 is provided for still further protecting the lower part of the back of the user. The handle 30 is attached onto the part that can be folded over with the wall opposite the one adjacent to the telescopic system, the supple material adjacent to this handle being internally reinforced by a small plate not illustrated.

Figure 4:
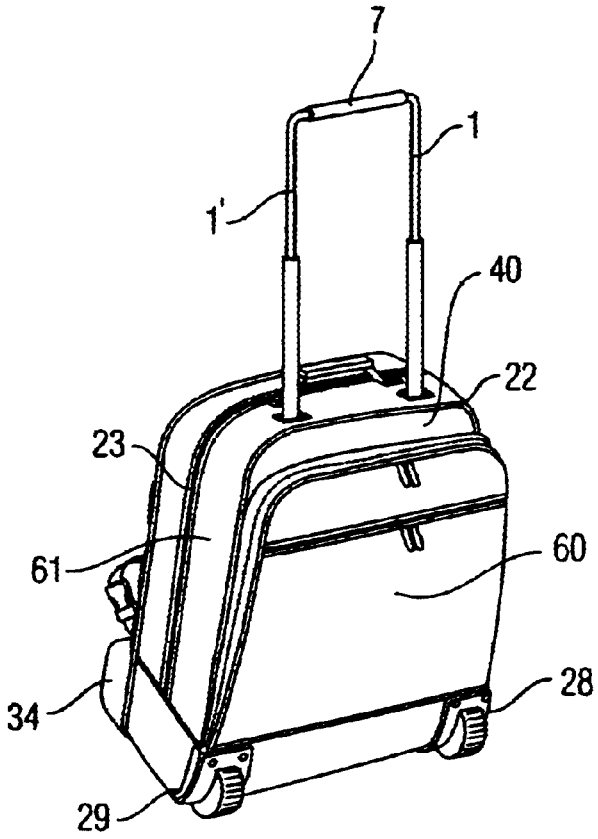
FIG. 4 represents a variant of the rucksack comprising a U-shaped handle.

FIG. 4 represents a variant of the rucksack such as represented in FIGS. 2 and 3, more adapted for baggage of large dimensions. The telescopic handle 7 indeed comprises two doubly telescopic rods 1, 1'. Moreover, this handle 7 can be retracted right inside the bag and be covered by a flap 40 with zip fastener.

FIG. 5*a* illustrates a variant of the invention in which there are no straps, nor dorsal cushion, the baggage thus constituting a cabin suitcase provided with a back carrying system. The rear wall 63 is rigidified by a metallic retaining ring and comprises a pocket 33' corresponding to the pocket 33 from FIG. 3 which, in this latter case, is suitable for receiving the detached straps.

Distinguishable in addition to the elements already described, are shoulder-strap attachment rings 41, 41' for a detachable shoulder-strap, the limit of the supporting plate 43, attached to the upper extremity of the housing (not shown), an upper handle 30 on a reinforcing plate independent of the plate 2 (not shown) and a lateral handle 44 on a reinforcing plate 45 provided under the fabric, as well as a metallic edging 46 (metal retaining ring) hooping the perimeter of the large rear wall 63 of the suitcase that can be folded over. The front wall adjacent to the telescopic system comprises an auxiliary storage compartment 52.

For this variant, as for a rucksack, an edging 22 can be provided which comprises a metallic element 50 forming an inverted U-shaped rigidification retaining ring, illustrated in FIG. 5*b*, running over three edges of the wall adjacent to the telescopic system. This retaining ring 50 is advantageously integrated into a supple edging whose extremities 22' exceed the branches of the U and are incurvated inside the arch 8, protected by the flange 29 in order thus to form the two lateral lower arrises 51.

Illustrated in FIG. 5*b* is the assembly of the edging 22 and of the metallic reinforcement running over three edges of the wall adjacent to the telescopic system. FIG. 5*c* is an enlargement of the profile in perspective of the edging 22 in which the element 50 is inserted at assembly.

FIG. 5*b* also shows an exploded reproduction of the base parts of the suitcase. Recognizable are the incurvated plate 2 provided with two openings 8 and made to form one piece with the flattened incurvated extremity 11 of the telescopic housing 10 not illustrated, the feet 6, the two arches 5 to be attached on the outside of the plate 2 and comprising a protective flange 29 conforming to the incurvation of the plate and forming the two lower corners of the suitcase, opposite the feet.

What is claimed is:

1. A rucksack comprising a front wall, a rear wall and two opposite side walls, said walls being made of supple material a retractable handle an incurvated base plate forming a bottom wall made to be integrated with a lower end of at least one telescopic housing of a rod of the retractable handle, said housing being provided internally in the rucksack adjacent to the front wall, the aforesaid base plate comprising openings at the incurvation, said openings receiving projecting wheels, an upper extremity of the telescopic housing being made to integrate a supporting plate of the supple material extending perpendicular to the telescopic housing, the rear wall provided with shoulder straps being opposite the front wall adjacent to the telescopic housing.

2. Rucksack according to claim 1 in which the base plate is made to form one piece with one or more incurvated extensions extending from a lower end of the telescopic housing of the rod of the retractable handle.

3. Rucksack according to claim 2 in which the base plate is semirigid and the incurvation of the plate is imposed by the formation into one piece of this plate with at least one incurvated extension extending from the base of the telescopic housing(s).

4. Rucksack according to claim 1 wherein the base plate is a rigid molded plate and the lower end of the telescopic housing is straight and attached to a raised part of the base plate.

5. Rucksack according to claim 1 wherein an edge of the base plate opposite a lower end of the telescopic housing has a concave curved horizontal section destined to conform to the transverse profile of a back of an user.

6. Rucksack according to claim 5 wherein there is provided a pad which adapts to a rim exhibited by the aforesaid edge.

7. Rucksack according to claim 1 wherein the upper extremity of the telescopic housing is attached to the perpendicular supporting plate of the supple material.

8. Rucksack according to claim 1 comprising an edging reinforced by an inverted U-shaped metallic element, delimiting and rigidifying the front wall adjacent to the telescopic housing, the edging extending beyond branches of the metallic element in order to incurvate and forming lower edges of side walls of the rucksack.

9. Rucksack according to claim 1 wherein the wheels are supported by arches which form lower corners of the fee wall adjacent to the telescopic housing, the aforesaid arches internally receiving an incurvated segment of the edging.

10. Rucksack according to claim 1 wherein the supporting plate and the incurvated base plate is covered on the outside with the supple material.

11. Rucksack according to claim 1 in which the incurvated plate is not covered with a supple material.

12. Rucksack according to claim 1 in which a reinforcing plate is provided extending partially downward from an upper edge of the wall adjacent to the housing of the retractable handle, the aforesaid reinforcing plate being made to form one piece with the aforesaid supporting plate by a bracket.

13. Rucksack according to claim 1 in which the supporting plate is an angle-iron plate of which one branch extends partially downward from an upper edge of the wall adjacent to the housing of the retractable handle.

14. Rucksack according to claim 1 presenting a generally rectangular prismatic configuration.

15. Rucksack according to claim 1 presenting a generally rectangular box-like configuration and comprising a rear wall, opposite to the wall adjacent to the telescopic housing, that can be folded over through a zip fastener system provided on three sides, and rigidified by a metallic retaining ring provided along its perimeter, suitable for being utilized as cabin suitcase.

16. Rucksack according to claim 1 presenting a generally rectangular box-like configuration and comprising an edging with an inverted U-shaped metallic element delimiting the front wall adjacent to the telescopic housing.

* * * * *

UNITED STATES PATENT AND TRADEMARK OFFICE

CERTIFICATE OF CORRECTION

PATENT NO. : 6,702,164 B1
DATED : March 9, 2004
INVENTOR(S) : De Lathouwer

It is certified that error appears in the above-identified patent and that said Letters Patent is hereby corrected as shown below:

Column 6,
Line 22, after "corners of the", delete "fee".

Signed and Sealed this

Twenty-ninth Day of June, 2004

JON W. DUDAS
*Acting Director of the United States Patent and Trademark Office*